United States Patent [19]

Harper, Jr. et al.

[11] 4,170,670

[45] Oct. 9, 1979

[54] FORMULATIONS FOR IMPARTING FLAME RETARDANCE TO CELLULOSIC FABRICS VIA TRANSFER TECHNIQUES

[75] Inventors: Robert J. Harper, Jr.; Timothy A. Calamari, Jr.; Sidney P. Schreiber, all of Metairie, La.

[73] Assignee: The United States of America as represented by the Secretary of Agriculture, Washington, D.C.

[21] Appl. No.: 866,078

[22] Filed: Dec. 30, 1977

Related U.S. Application Data

[63] Continuation-in-part of Ser. No. 555,486, Mar. 5, 1975.

[51] Int. Cl.[2] ..... B05D 3/10

[52] U.S. Cl. ..... 427/341; 427/390 D; 428/921

[58] Field of Search ..... 427/341, 390 D; 428/920, 921

[56] References Cited

U.S. PATENT DOCUMENTS

| | | | |
|---|---|---|---|
| 3,096,201 | 7/1963 | Coates | 427/341 |
| 3,236,676 | 2/1966 | Coates et al. | 427/341 |
| 3,276,897 | 10/1966 | Reeves | 427/341 |
| 3,310,419 | 3/1967 | Wagner | 427/341 |
| 3,310,420 | 3/1967 | Wagner | 427/341 |
| 3,784,356 | 1/1974 | Wagner | 427/341 |
| 3,919,439 | 11/1975 | Perkins et al. | 427/341 |
| 3,953,165 | 4/1976 | Pepperman | 427/341 |
| 3,975,560 | 4/1976 | Daigle | 427/341 |
| 4,013,813 | 3/1977 | LeBlanc | 427/341 |

*Primary Examiner*—Ronald H. Smith
*Assistant Examiner*—Janyce A. Bell
*Attorney, Agent, or Firm*—M. Howard Silverstein; David G. McConnell; Salvador J. Cangemi

[57] ABSTRACT

Cotton fabric and cotton-blended fabric which has been sensitized by treatments with methylol phosphorus compounds and heat-dried have been subjected to a "wet-transfer" technique which transfers a formaldehyde donor along with an aqueous ammonium hydroxide solution, thus providing an improved process for imparting flame retardance to fibrous cellulosic materials.

8 Claims, No Drawings

FORMULATIONS FOR IMPARTING FLAME RETARDANCE TO CELLULOSIC FABRICS VIA TRANSFER TECHNIQUES

CROSS-REFERENCES TO RELATED APPLICATIONS

This is a Continuation-in-Part of Ser. No. 555,486, filed Mar. 5, 1975.

BACKGROUND OF THE INVENTION (1) Field of the Invention

This invention relates to an improved process and improved compositions for imparting flame retardance to cotton and other fibrous cellulosic materials. More specifically, this invention relates to the improved process and compositions resulting from incorporating formaldehyde donors into the ammonium hydroxide curing formulations and applying these to the sensitized fabric by means of a "wet transfer" padding technique, thus providing an improved process for the preparation of cotton fabric and other cellulosic material with fire retardant properties.

(2) Description of the Prior Art

Methylol phosphorus based polymers which have nitrogen atoms incorporated in the polymers are known to have excellent flame-retardant properties. Such polymers are particularly suitable in the treatment of cellusosic materials such as cotton, rayon, jute, ramie, paper, cotton-blended fabrics, etc. Numerous processes have been developed for treating cellulosic materials with such polymers. U.S. Pat. No. 2,668,096 describes a process wherein cotton fabric is impregnated with an aqueous solution of tetrakis(hydroxymethyl)phosphonium chloride (Thpc), and a cyclic-nitrogen containing compound, and then heated at an elevated temperature. Although this particular process produces good fire-retardance it tends to weaken the tensile properties of the fabric and make it unsuitable for many applications where strong fabric are required.

U.S. Pat. No. 3,236,676 discloses a process wherein ammonia reacts with partially or completely neutralized Thpc to produce adducts and polymers. Cellulosic materials are impregnated with partially or fully neutralized Thpc and heated at a high temperature or alternately at a lower temperature for a longer time period to place the Thpc in the cellulosic fiber. Subsequently, the thoroughly dried textile is exposed to ammonia.

U.S. Pat. No. 3,607,356 discloses a process wherein the cellulosic material is impregnated with tetrakis(hydroxymethyl)phosphonium hydroxide (THPOH) or fully neutralized Thpc (pH of 7 or above), then the cellulosic material is partially dried and exposed to ammonia gas to produce insoluble flame-retardant polymer in the textile.

The efficiency of polymer formation in a cellulosic textile is very low when the textile is impregnated with Thpc and the dried textile is subsequently exposed to ammonia. Thpc, which is strongly acidic (pH about 2) reacts slowly with ammonia, and with amides, to produce insoluble polymers. Reaction is accelerated or promoted by partial or complete neutralization (pH about 7.5) with a base. Therefore, such a process without neutralization is not a satisfactory commercial method for imparting flame resistance to textiles. Besides, much of the flame retardant is removed by laundering. When Thpc is partially or fully neutralized with a base and applied to fabric as shown, polymer formation is efficient when the dried or partially dried fabric is exposed to ammonia gas.

The standard procedure used for the commercial production of THPOH—$NH_3$ finished flame retardant cotton fabrics involves the use of ammonia gas as curing agent. From the viewpoint of the textile industry, the use of ammonia gas poses several disadvantages. First, the industry is currently equipped to treat fabric using aqueous systems to impart finishing chemicals to fabric. In order to use ammonia gas, special curing chambers must be designed, built and placed in a finishing line. To permit operation at modern finishing speeds, textile manufacturers must use large and costly chambers. Because the fabric is passing through these chambers in a continuous manner, it is not possible to completely seal these chambers. As such, there is a tremendous loss of ammonia from the chambers so that the plant atmosphere poses a health hazard to the workers. Indeed, this odor is often so permeating that only people wearing gas masks can stay in the immediate vicinity of the operation. The rapid escalation of ammonia prices has made the loss of ammonia in the air an economic consideration as well as a health factor. Also, a basic gas floating around a textile mill poses an added problem because most operations are acid catalyzed and there is a potential for interference with these catalysts. In addition, the necessity for gas to penetrate to all regions of the fabric would appear to raise a problem with respect to evenness of treatment in high speed operations. Modern flammability test requirements are such that each and every sample of treated fabric must be able to pass the bone dry flammability test, i.e., Children's Sleepwear Standard, DOC FF3-71, Fed. Register, July 29, 1971. Finally, because the use of gas finishing techniques represents an entirely new technology to most textile companies, there is a reluctance on their part to produce products which require new technology and new equipment.

For these reasons, it was deemed advantageous for the ammonia to be added to an aqueous phase in the form of ammonium hydroxide or other ammonium salts. Previous attempts to do this by running a fabric treated with THPOH into an aqueous system containing ammonium hydroxide were unsatisfactory for several reasons. First, the THPOH is water soluble and much of the THPOH on the fabric would be leached into the aqueous bath, where a polymer quickly forms. This polymer is deposited both in the bath and on the squeeze rolls, thus interfering with bath life and roller efficiency. A second consequence of this leaching is that the treated fabric now has insufficient polymer to pass the flammability tests. To demonstrate this several experiments were performed which would indicate typical results from the various approaches. Thus, two samples of cotton fabric were padded with 35% THPOH and dried. One sample was ammoniated as described by Beninate et al. U.S. Pat. No. (3,607,356) and gave a phosphorus analysis of 5.8% (subsequent to oxidation). By contrast the companion sample was padded with ammonium hydroxide and then oxidized. This latter sample had a phosphorus analysts of 1.5%. A phosphorus content of 3.5–4.0% is required to produce a fabric which will pass the modern flammability test initially and after 50 launderings. Thus, it can be seen that taking a sample of THPOH fabric and padding or putting it through a bath of ammonium hydroxide does not produce a flame-retardant fabric.

SUMMARY OF THE INVENTION

Formulations for imparting flame retardance to cotton and other fibrous cellulosic blended fabrics via transfer padding techniques have been improved by adding a formaldehyde donor to an aqueous ammonium hydroxide curing solution. The cotton or cotton-containing fabric is first sensitized by impregnation with a methylol phosphorus compound and heat-drying. The sensitized fabric is then cured by applying a solution of a formaldehyde donor in an aqueous ammonium hydroxide solution by means of an indirect transfer curing technique.

The main object of this invention is to provide an improved process for imparting flame retardance to fibrous cellulosic materials.

DESCRIPTION OF THE PREFERRED EMBODIMENTS

The difficulties and deficiencies normally associated with the use of ammonium hydroxide solutions for curing THPOH-sensitized cellulsoic fabrics have been overcome by the process of the present invention.

Methylol phosphorus compounds suitable for use in this invention have the following formula:

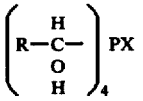

where X is a halogen, acetate, sulfate, oxalate, or phosphate and R is selected from the group consisting of hydrogen, alkyl having from one to three carbon atoms, and halo alkyls having from one to three carbon atoms.

The textile treating solutions suitable for use in this invention are prepared by adding a solution of an alkali metal hydroxide to a solution of the methylol phosphorus compound (MPC). Hydroxides suitable for use in this invention are soluble hydroxides selected from the group consisting of sodium, potassium, lithium, magnesium, and calcium. Sodium and potassium hydroxides are the preferred bases. The mole ratio of base to MPC should be in the range of 0.7/1.0 to 0.9/1.0. The efficiency of polymer formation upon curing is highest with the mole ratios of base to MPC specified above. Depending on the source of the MPC, the pH of the pad bath will vary from about 6.9 to 7.5 but any value within this range is suitable for use in this invention.

Cellulose-containing textiles suitable for use in this invention include products made from cotton, rayon, jute, ramie, and paper, and products which contain a major portion of these fibers along with minor portion of such fibers as those made of polyesters, polyamides, polyacrylics, wool, and polypropylene. The fibrous textile materials are impregnated with solutions of the methylol phosphorus compound using various techniques including padding, spraying, immersing, and centrifuging and the like conventional textile processing methods. The amount of methylol phosphorus compound applied to the textile material is dependent upon the amount of durable flame retardant to be developed in the textile product. Generally, the amount of methylol phosphorus compound applied to the textile structure will range from about 5% to about 35%, with the higher portion of the range being used where it is necessary to pass modern flammability tests.

The textile material which has been impregnated with the neutralized methylol phosphorus compound solution can be partially or completely dried by any of several conventional processes. The textile structures can be dried at temperatures up to about 120° C.

The process of the instant invention consists of fixing methylol phosphorus compounds in cellulosic materials with ammonium hydroxide donor solutions. The process involves the use of an indirect transfer technique in which the ammonium curing solution is transferred in limited quantites to dry cotton fabric containing methylol phosphorus compound. This transfer is achieved by either of two general methods.

In the one method, the ammonium hydroxide donor solution is brought to and squeezed into the fabric to be cured by means of a kiss roll. In the other, a looped fabric is used on either a two-roll padder or a three-roll padder, and the ammonium hydroxide donor solution transferred from the pad bath to the sensitized fabric to be cured by means of the fabric loop. When a two-roll padder is used with a fabric loop, the loop first passes through the ammonium hydroxide donor solution in the pad bath, then is squeezed between a pair of rolls along with the fabric to be cured, so that a limited amount of solution is transferred from the wet loop to the dry fabric containing the THPOH. When a three-roll padder is used with a fabric loop, the loop first passes through the ammonium hydroxide donor solution in the pad bath, then is squeezed between the first and second rollers to remove excess solution. The loop then passes between the second and third rollers along with the fabric to be cured so that a limited amount of solution is transferred from the wet loop to the dry fabric containing the THPOH. The term "kiss roll padding" is used to refer to the transfer of chemical agent using a kiss roll. The term "loop transfer" refers to the transfer of chemical agent using a fabric loop on either a two-roll or a three-roll pad, and the term "padding" refers to the conventional immersion of fabric in a solution of chemical agent followed by the squeezing of the wet fabric between a set of rollers to remove excess solution.

After the initial transfer of ammonium agent to the fabric via either a fabric loop or kiss roll, the fabric can be dried and polymer add-on and durability augmented by a subsequent treatment with ammonium hydroxide donor solution. Because the initial transfer technique fixes the polymer in place, the second treatment can be done by kiss roll padding, transfer padding with a loop, or by immersion padding. Kiss roll padding and loop-transfer padding eliminate the back transfer of phsophorus agent to the ammonia bath, prevent formation of polymer in the treating bath, and produce high phosphorus levels on the fabric to be treated. As a consequence of this, flame retardant fabrics containing 5–7% phosphorus are produced by these methods. This contrasts with comparable values of 5.8% for the gaseous treatment and 1.5% for the padding treatments previously noted in this application. In addition to elimination of leaching, another significant element in these transfer techniques is the limited amount of water introduced by these transfer padding techniques. The amount transferred is a function of belt fabric, squeeze roll pressures, and depth of kiss roll in solution.

Wet pick-ups in the range of 5% to 51% can be achieved by these methods. However, a range of about from 12% to 48% is preferred in the process of the instant invention. This contrasts with a normal fabric wet pick-up of 80% to 90% in padding operations. In view of the statements by Beninate et al (U.S. Pat. No. 3,607,356) with respect to moisture content, the advantages of transfer techniques are apparent.

The addition of a formaldehyde donor to the ammonium hydroxide curing bath further improves the polymer fixation efficiency. The addition of formalin (formaldehyde in water), paraformaldehyde, hexamine, methylol melamine, or THPOH in a weight ratio of about 1:20, formaldehyde to ammonium hydroxide, respectively, into an ammonium hydroxide bath containing from 15% to 30% $NH_3$ (30.9% to 61.8% $NH_4OH$) increased the polymer fixation efficiency in every case as estimated by nitrogen and phosphorus analyses. The efficiency can be further enhanced by the transfer of additional curing bath in subseuqent indirect wet transfers or in an immersion step subsequent to the initial wet transfer.

The following examples are provided to further illustrate the preferred embodiments of the invention and should not be construed as limiting the invention in any manner whatsoever.

EXAMPLE 1

An aqueous solution was prepared by adding with continuous stirring a solution of 114 grams of sodium hydroxide in 500 grams of water to 1034 grams of 75% tetrakis(hydroxymethyl)phosphonium chloride (Thpc) solution. To this solution was added 2 grams of a nonionic wetting agent and sufficient water to adjust the solution weight to 2000 grams. The molar ratio of NaOH/Thpc in this solution was 0.7/1.0. The pH of this solution was 7.0.

A piece of cotton flannelette weighing 4.0 oz. per square yard was impregnated with this solution to give about a 110% wet pickup. The impregnated fabric was dried in a gas fired forced draft oven for about one and one-half minutes at 75° C. The moisture content of this THPOH-sensitized fabric was about 15%.

A concentrated solution of ammonium hydroxide (30% $NH_3$ in $H_2O$) was then transferred to this sensitized fabric using a loop-transfer technique on a three-roll horizontal pad. This technique involves the use of a continuous fabric loop such that the loop picks up curing solution by passing under a submerged bar, travels upward to be squeezed between the first and second rolls to remove excess solution, then travels between the second and third rollers where it comes in contact with the THPOH-sensitized fabric and where transfer of ammonium hydroxide is made. Two transfers were used without an intermediate drying step.

The THPOH-sensitized sample which was cured with the concentrated ammonium hydroxide was compared with other samples which were cured with formulations of various formaldehyde donors dissolved in the concentrated ammonium hydroxide. The various donors, the percent nitrogen and phosphorus, and the results of an initial DDC screening test are given and compared in Table I.

TABLE I

| Sample | % Formaldehyde donor in conc. $NH_4OH$ curing solution | % Wet pick-up | % N | % P | Initial DOC char length (in.) |
|---|---|---|---|---|---|
| 1 | none (control) | 51 | 1.75 | 3.65 | 10 |
| 2 | 3% formaldehyde | 48 | 1.92 | 4.08 | 1.3 |
| 3 | 5% paraformaldehyde | 43 | 2.04 | 3.93 | 2.3 |
| 4 | 5% hexamine | 42 | 2.17 | 4.44 | 3.4 |

TABLE I-continued

| Sample | % Formaldehyde donor in conc. $NH_4OH$ curing solution | % Wet pick-up | % N | % P | Initial DOC char length (in.) |
|---|---|---|---|---|---|
| 5 | 5% methylol melamine | 43 | 2.42 | 4.79 | 2.0 |
| 6 | 5% of a 35% THPOH soln. | 47 | 2.26 | 4.62 | 2.6 |

All analytical data given in Table I were obtained after the cured samples were process washed to remove soluble salts, oxidized with a solution of 2% $H_2O_2$, rinsed and dried. Table I shows that the presence of formaldehyde donors increases nitrogen fixation from 9.7% to 38.3%, and phosphorus fixation from 7.7% to 30.7%.

These calculations were made by dividing the increase in nitrogen content of Sample 2 (relative to Sample 1) by the nitrogen content of Sample 1 (the control) to obtain 9.7%, for example, and the increase in nitrogen content of Sample 5 (relative to Sample 1) by the nitrogen content of Sample 1 to obtain the 38.3% . . .

The sample which was cured with ammonium hydroxide alone, under the relatively high transfers used in the investigation, did not pass the DOC test initially, whereas those samples which did use formaldehyde donors all passed this screening test.

Attention is called to Table I, Sample 4, wherein 5% hexamine is used as the formaldehyde donor. Calamari, et al, in a paper, "Fire Retardant Cottons Via Transfer Curing Techniques," American Dyestuff Reporter, April 1976 (No. 6), disclose in p. 31, that "When a 43 percent hexamine solution was used for the transfer, very little phosphorus or nitrogen was fixed, and the sample failed the DOC flame test." Obviously, Calamari et al were attempting to use an aqueous solution of hexamine to cure a THPOH sensitized fabric. They were unaware at that time that an aqueous solution of hexamine is not effective in such an application unless a large amount of ammonium hdyroxide is also present in solution.

Now it has been discovered that when hexamine is dissolved in a concentrated solution of $NH_4OH$, the hexamine, $(CH_2)_6N_4$, functions as a formaldehyde donor and increases the effectiveness of the $NH_4OH$ curing solution so that increased amounts of phosphorus and nitrogen are fixed in a THPOH sensitized fabric.

EXAMPLE 2

This Exmple is identical to Example 1, except that the only curing solutions used were concentrated ammonium hydroxide and a 5% solution of hexamine in concentrated ammonium hydroxide. Wet transfers were adjusted to give about 7% wet pickup of curing agent on the first transfer and an additional 5% wet pickup on the second transfer. Under these conditions the sample cured with concentrated ammonium hydroxide alone had 1.95% bound nitrogen, passed the initial DOC flame test, but failed the DOC test after 50 launderings. The sample with the 5% hexamine added to the concentrated ammonium hydroxide agent had 2.79% bound nitrogen, and passed the DOC test both before and after 50 launderings.

We claim:

1. An improved process for imparting flame retardance to cotton fabrics and to cellulosic blended fabrics, the process comprising:

(a) mixing a formaldehyde donor with an ammonium hydroxide solution in a bath for curing THPOH-sensitized fabrics, and (b) applying a limited amount of the solution to the sensitized fabric by transfer padding techniques.

2. The process of claim 1 wherein the donor is formalin.

3. The process of claim 1 wherein the donor is paraformaldehyde.

4. The process of claim 1 wherein the donor is hexamethylenetetramine.

5. The process of claim 1 wherein the donor is methylol melamine.

6. The process of claim 1 wherein the donor is tetrakis(hydroxymethyl)phosphonium hydroxide.

7. The process of claim 1 wherein the weight ratio of donor to ammonium hydroxide is about 1:20.

8. The process of claim 1 wherein the limited amount of the solution is about from 12% to 48% of the weight of the THPOH-sensitized fabric.

* * * * *